United States Patent [19]

Lenker

[11] 4,181,449

[45] Jan. 1, 1980

[54] PAVING JOINTS

[76] Inventor: Earl A. Lenker, 2916 Michele Dr., Norristown, Pa. 19403

[21] Appl. No.: 930,385

[22] Filed: Aug. 2, 1978

[51] Int. Cl.[2] ..... E01C 23/02

[52] U.S. Cl. ..... 404/87; 404/74; 404/118

[58] Field of Search ..... 404/87, 98, 104, 50, 404/74, 118, 47, 114

[56] References Cited

U.S. PATENT DOCUMENTS

| | | | |
|---|---|---|---|
| B 346,901 | 1/1975 | Aparicio | 404/98 |
| 2,225,481 | 12/1940 | Lundbye | 404/108 |
| 2,864,290 | 12/1958 | Freeman | 404/114 X |
| 3,680,451 | 8/1972 | Birtchet | 404/104 |
| 3,838,933 | 10/1974 | Leitman | 404/114 |
| 3,851,989 | 12/1974 | Peach | 404/50 |
| 4,068,969 | 1/1978 | Beach | 404/104 X |

*Primary Examiner*—Nile C. Byers, Jr.
*Attorney, Agent, or Firm*—Frederick J. Olsson

[57] ABSTRACT

Method and equipment employed on a conventional paver makes a tapered joint between adjacent paved sections. Joint has two wedge shaped, highly compacted, overlying layers.

16 Claims, 13 Drawing Figures

PAVING JOINTS

This invention relates in general to the paving of roads, airports, parking lots and the like.

More specifically the invention relates to improved longitudinal joints in such paved areas and in methods and apparatus employed on a conventional paver and operative during a paving operation for making the joints.

The invention contemplates a tapered joint between two adjacent asphalt sections formed as by two wedge-shaped, highly compacted overlying layers. By tapered is meant that the plane or locus of the joint is canted or not vertical as in the standard conventional joint.

One object of the invention is to overcome the longevity problem inherent with the conventional vertically extending longitudinal joints which has existed since the development of the asphalt paving machine 50 years ago and which has never been corrected.

Another object of the invention is to provide a joint which not only replaces the conventional longitudinal joint in asphalt roadways but is especially useful and advantageous to interface the roadway shoulders.

The longivity problem referred to is simply that with the conventional vertical joint there is deterioration as early as 2 years after installation and by 6 years the joint has spalled and created pothole problems requiring extensive patching and or resurfacing. The present invention seeks to extend the life of the joint to 12 years or more with consequent enormous savings both in labor and in petroleum derived material.

The method, apparatus, and the joint formed thereby will be explained below in conjunction with the following drawings wherein.

Figure 1:
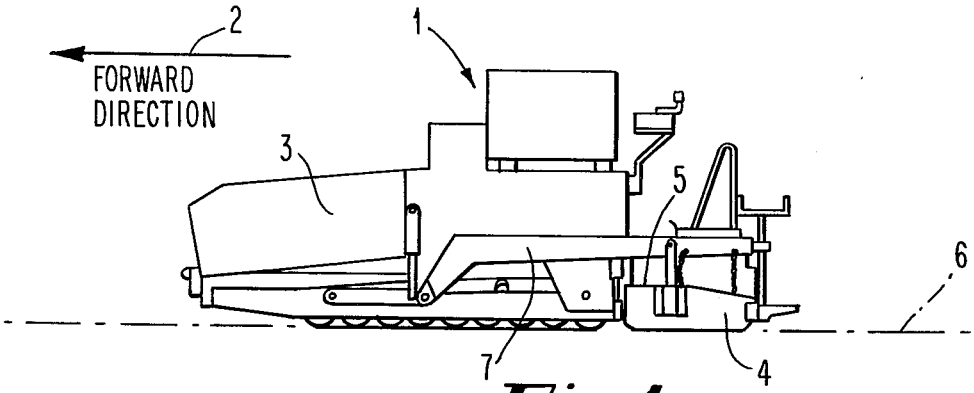
FIG. 1 is a side view of a typical asphalt paver.

Referring to FIG. 1, I have illustrated a typical asphalt paving machine 1. In a paving operation, the machine proceeds in a direction of the arrows 2. Asphalt is dumped to the hopper 3 from which it is fed rearwardly and outwardly to present a mass extending transversely across the machine between side plates (one of which is noted at 4) in front of the screed 5 which is spaced above the surface 6. As the machine moves forward, asphalt goes under the screed where it is compacted on the surface 6.

In a paving operation the machine will travel in one direction laying down a section of asphalt which is subsequently rolled by equipment not shown to further compact the material.

Then the machine is reversed in direction and lays down an adjacent section which is also rolled. The two sections are interfaced by a longitudinal joint.

The apparatus of the present invention is disposed on the side of the machine between the screed and the side plate. As the machine is moved forward, asphalt goes under the apparatus where it is compacted to form a wedge shaped layer so that the longitudinal joint is tapered rather than vertical. A typical joint is diagramatically illustrated in FIG. 2.

A pair of adjacent paved sections 10 and 11 are connected by the joint area 12. The sections 10 and 11 have planar top or work surfaces 13 and 14. The longitudinal edges of the section 10 are indicated at 15 and 16. The longitudinal edges of the section 11 are indicated at 17 and 18.

The joint area 12 includes wedge or triangular shaped, overlying layers 20 and 21. The layer 20 extends out from the edge 15 and is tapered downwardly to form the end surface 22. The layer surface 21 extends out from the edge 18 and overlies the layer 20 and is tapered upwardly from the surface 6 to form the end surface 23 which tightly engages the surface 22. The engagement of the surfaces 22 and 23 forms a tapered longitudinal joint 24, that is to say, a joint which is not vertical or is oriented with respect to the surfaces 13 and 14 an angle less than 90°. An acute angle of 20° is preferred.

Figure 2:
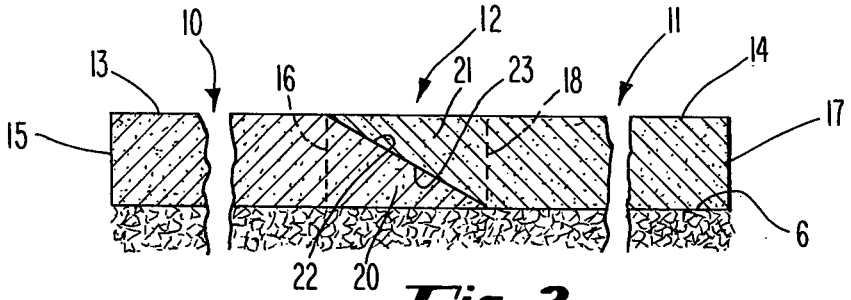
FIG. 2 is a elevational sectional view diagrammatically illustrating the tapered joint of the invention.

Dimensions for a typical joint as illustrated in FIG. 2, for a top or finish course, may be as follows. Each of the sections 10 and 11 may be approximately 10 feet in width and 1½ inches in height with the layers 20 and 21 extending outwardly from the respective edges a distance of about 6½ inches. This forms an acute angle for the joint 24 of about 20°.

The apparatus and its use in making the above joint 24 will now be described.

Figure 3:
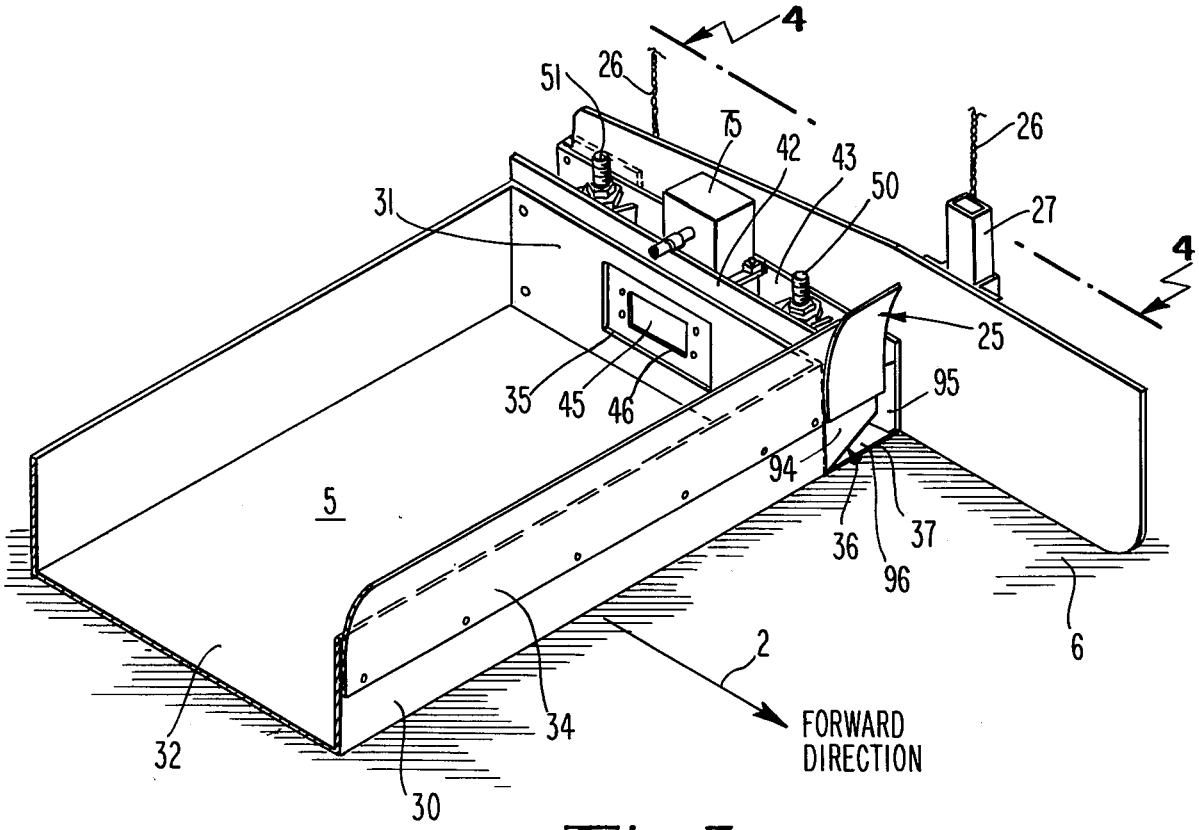
FIG. 3 is a perspective view of a typical screed and machine side plate of the kind employed in the machine of FIG. 1 with the apparatus of the invention disposed therebetween.

Referring to FIG. 3, the apparatus 25 of the invention is between the machine side plate 4 and the screed 5. For simplification purposes, only a portion of the full transverse width of the screed 5 is illustrated. The apparatus is supported on one end of the screed 5 and engages the side plate 4 in a snug, sliding fit. The screed and side plate, except as slightly modified to accommodate the joint apparatus 25, are conventional. The side plate 4 is supported from the machine 1 by the chains 26 and the adjusting bracket 27. The plate can be adjusted both in a vertical and transverse direction. Normally the side plate is vertically adjusted so that it rests on the surface 6 and can move vertically relative to the apparatus 25 in response to irregularties or contours in the surface 6.

The screed 5 has a front plate 30, an end plate 31, a bottom or compacting plate 32 and a rear plate 33. The front plate 30 includes the deflector 34. The screed end plate 31 has an opening 35. Plate 30 tends to direct asphalt underneath plate 32.

The asphalt mass from hopper 3 extends in front of the screed plate 30 and in front of the apparatus 25 out to the machine side plate 4. As the machine is moved forward, the asphalt goes under the screed and under the apparatus 25 where it is compacted on the surface 6. Thus, the screed 5 paves a section (such as section 10 or 11) and the apparatus 25 paves a layer (such as a layer 20 or 21).

The apparatus 25 includes the front baffle 36 which is essentially co-planar with the front plate 30 of the screed and serves the same purpose. The apparatus 25 also includes the bottom plate 37 interconnected with and supported by the screed 5. Note that the bottom plate 37, like the screed compactor plate 32 is disposed above the surface 6 to form a space for receiving asphalt. The bottom plate does the actual forming and compacting of the asphalt making up a layer and in that sence acts similarly as the compactor plate 32 of the screed. The plate 37 extends outwardly at an appropriate angle for forming the taper in the layer as will be explained later.

The details of construction of the apparatus 25 will now be described.

Figure 4:
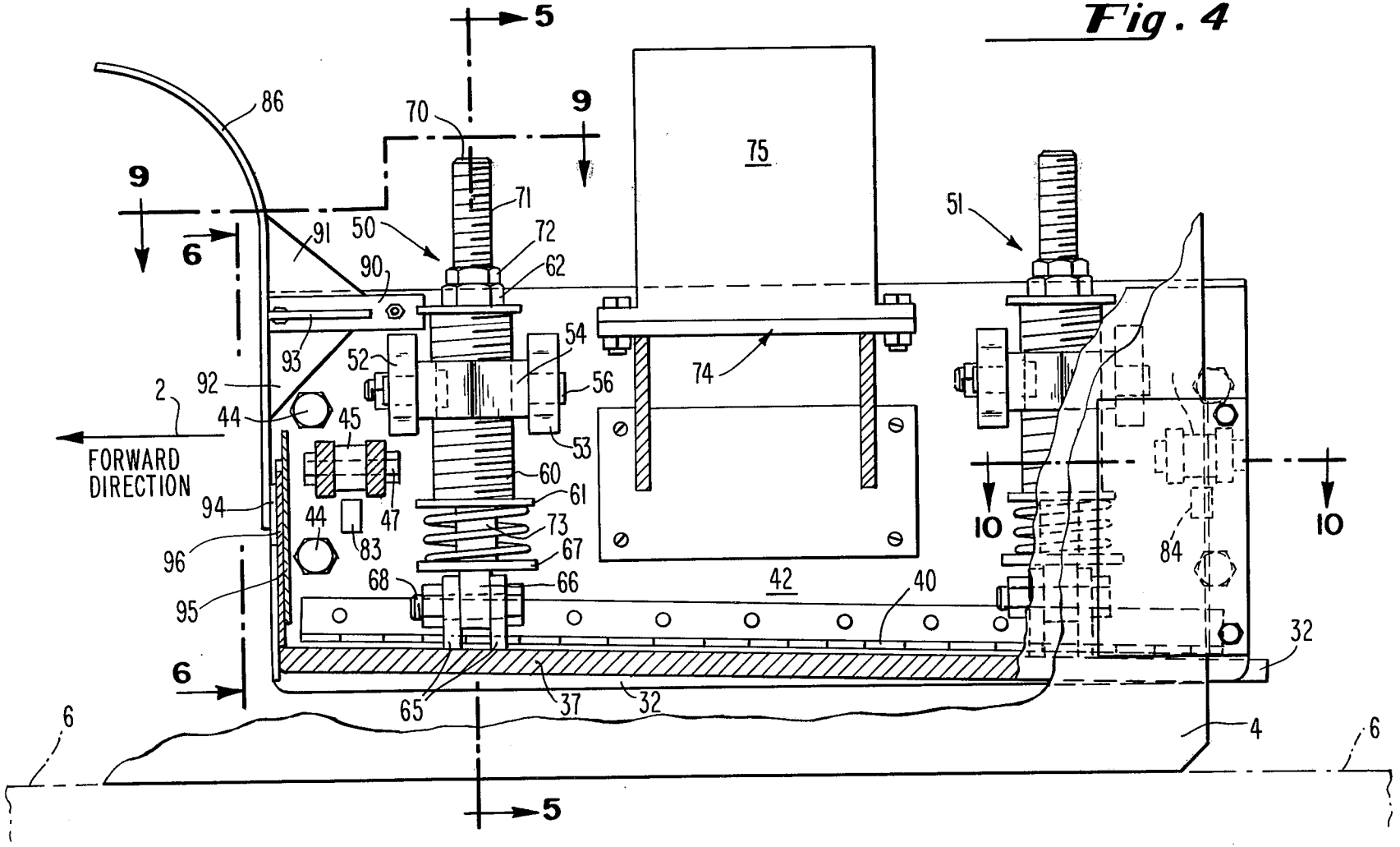
FIG. 4 is an elevational view partially in section and with certain components broken away taken along the line 4—4 of FIG. 3.
Figure 5:
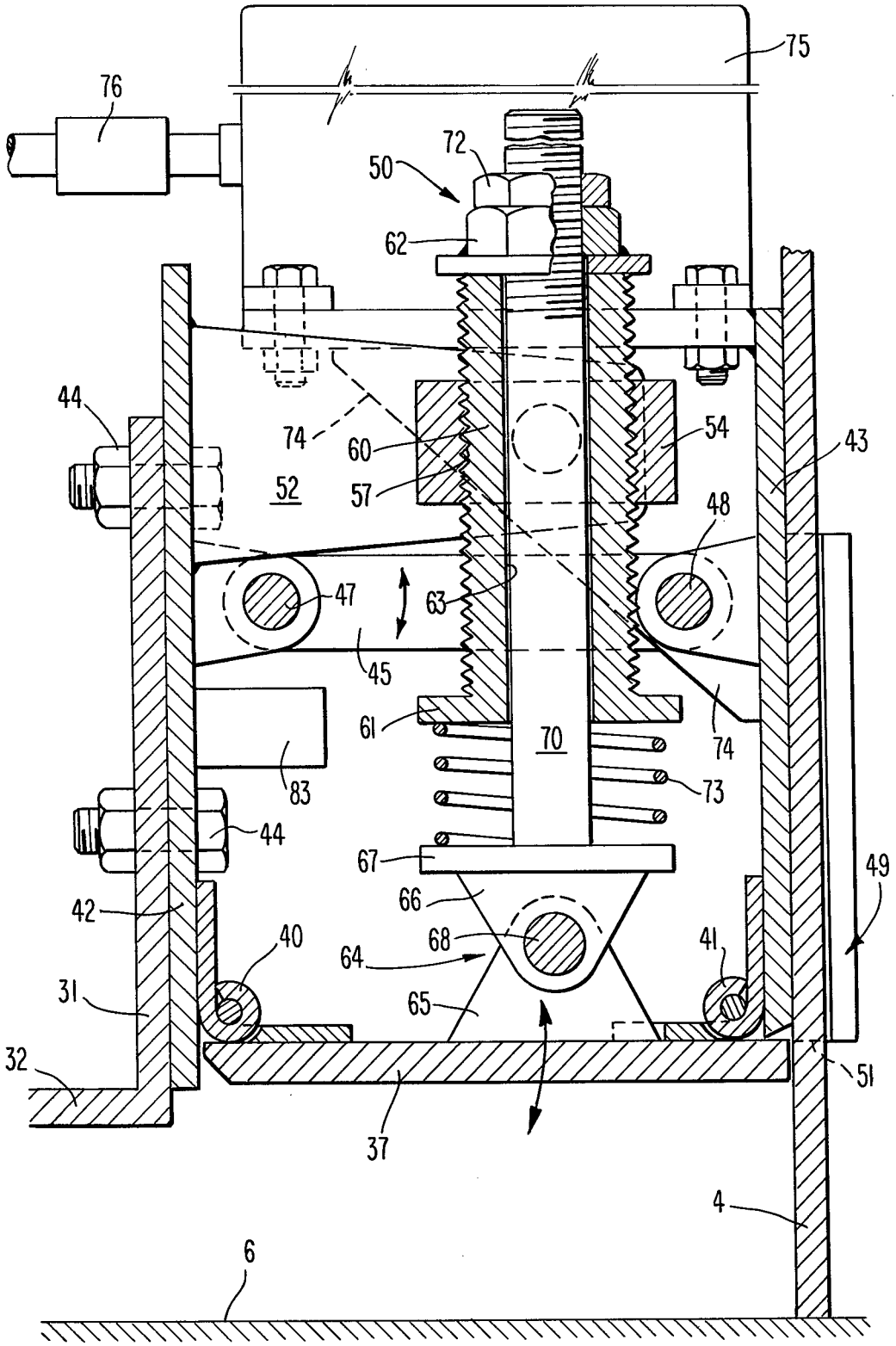
FIG. 5 is a elevational view partially in section with certain parts removed taken along the lines 5—5 of FIG. 4.

Referring to FIG. 5, the bottom plate 37 in the lateral direction extends between the screed end plate 31 and the machine side plate 4. In a fore and aft direction (FIG. 4), the bottom plate 37 extends from the screed front plate 30 back along and substantially co-extensive with screed compacting plate 32.

It will be noted that the forward end of the bottom plate 37 is raised slightly above the forward end of the screed compacting plate 32. The plate 37 is biased downwardly to the rear so that the trailing edges of the plates 37 and 32 are flush. The reason for this is commented on later.

The plate 37 is connected to screed 5 for support thereby by the connecting means described following:

The opposite edges of the bottom plate 37 fixedly mount hinges 40 and 41 (FIG. 5) which are preferably the piano type and extend co-extensive with the plate. The hinge 40 is fixed to an inboard plate 42 and the hinge 41 is fixed to an outboard plate 43.

The inboard plate 42 is co-extensive with the bottom plate 37 and is fixed to the screed end plate 31 by nut/-bolt means 44. The outboard plate 43 is parallel to the inboard plate 42 and co-extensive therewith. The outboard plate slidingly engages the machine side plate 4.

Just above the center of the plates 42 and 43 are disposed the forward link 45 and the rear link 46. The links extend parallel the bottom plate 37 between the inboard and outboard plates 42 and 43. The link 45 is connected to the inboard plate 42 by the pivot means 47 and to the outboard plate 43 by the pivot means 48. The rear link 46 is similarly secured. The hinges 40 and 41 and the pivotally mounted links 45 and 46 create a parallelogram effect which provides for the bottom plate 37, the outboard plate 43 and the links 46 and 47 to move so that the bottom plate 37 may be adjusted with respect to the screed as noted in FIGS. 6, 7 and 8.

In making any of the above adjustments, it will be understood that the side plate 4 may be raised off the surface 6 so that it can more easily be shifted laterally as required.

Figure 10:
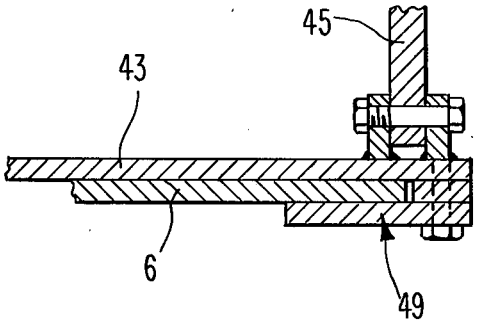
FIG. 10 is a plan view taken along the lines 10—10 of FIG. 4.

Note that at the rear of the apparatus, the outboard plate and the machine side plate are maintained in sliding engagement by the holder 49 (FIG. 10) which is fixed to the outboard plate and extends around the end and over the side plate.

Between the inboard and outboard plates are vertical supports 50 and 51 which make an adjustable, yieldable connection between the bottom plate 37 and the screed. These supports are identical so the description will only be in connection with support 50.

The supports 50 and 51 provide a means for adjusting the angle of the plate 37, a means for adjusting the compacting pressure of the plate and provide for the plate to partake of limited pivoting motion about the hinge 40 to accommodate irregularties or change in contour of the surface 5 which still exerting the desired compacting pressure.

Figure 9:
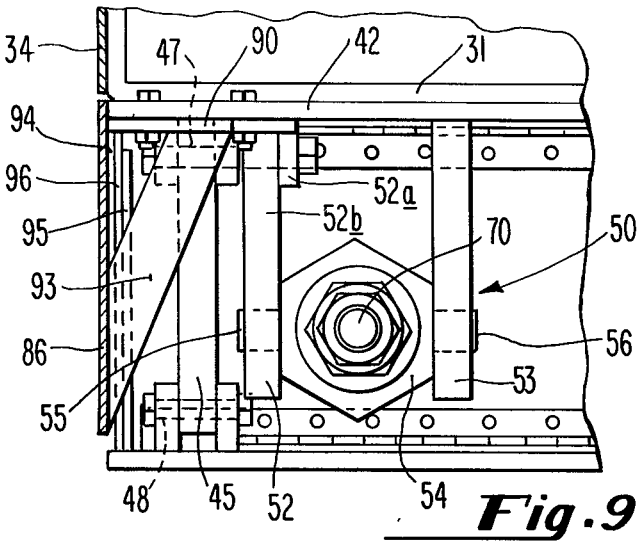
FIG. 9 is a plan view taken along the lines 9—9 of FIG. 4.

Referring to FIGS. 4, 5 and 9 a pair of supports arms 52 and 53 are connected to and extend outwardly of the inboard plate 42. Between the arms is a nut 54 having trunions 55 and 56 rotatably mounted in apertures in the arms 52 and 53. The arrangement permits the nut to have a slight rocking motion. As noted, the arm 52 is formed of parts 52*a* and 52*b* part 52*a* being welded to the plate 42 and the part 52*b* being bolted to part 52*a*. This latter construction is for assembly purposes. The nut carries a threaded, vertically extending paerture 57.

The aperture 57 carries a threaded adjusting sleeve 60, the bottom of which has a foot 61 and the top of which carries turning means in the form of a nut 62 welded in place. The sleeve has a vertical bore 63. The sleeve can be moved up and down in the nut 54 as by turning the nut 62.

The bottom plate 37 carries a pivot means 64, the pair of outer arms 65 of which are welded to the plate 37 and the inner arm 66 carries the platform 67. The arms are joined by the pin means 68.

The arms 65 and the arm 66 make a relatively loose sliding fit with each other and with the pin 68, the purpose of which will be commented on later.

Fixed to the platform 67 is a shaft 70 which extends upwardly thru and makes a sliding fit with the bore 63. The top of the shaft is threaded at 71. The threads 71 carry an adjusting nut 72 which is slidably engaged with the nut 62.

Surrounding the shaft 70 is a compression spring 73 which bears between the foot 61 and the platform 67. The spring 73 urges the platform 67 and shaft 70 in a downward direction hence urges the nut 72 against the nut 62. The spring 73 can be compressed or expanded by appropriately positioning the nut 72 on the shaft 70 thus controlling the force developed by the spring.

An upward force on the plate 37 will push the shaft 70 upwardly in bore 63 and raise the nut 72 away from the nut 62, the upward motion being resisted by spring 73. When the force is relieved, the spring will push the shaft 70 and plate 37 down until nut 72 engages nut 62.

Figure 7:
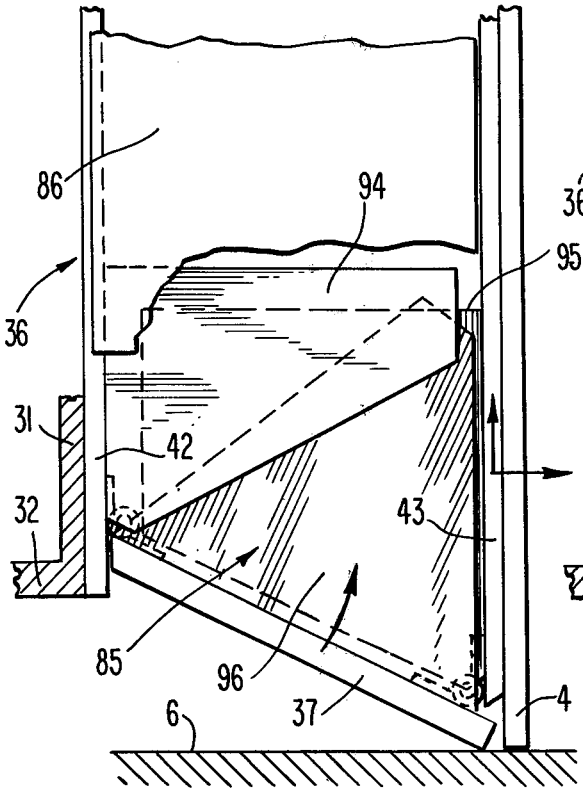
FIG. 7 is a view similar to FIG. 6 and illustrating the fully down position of the apparatus.
Figure 6:
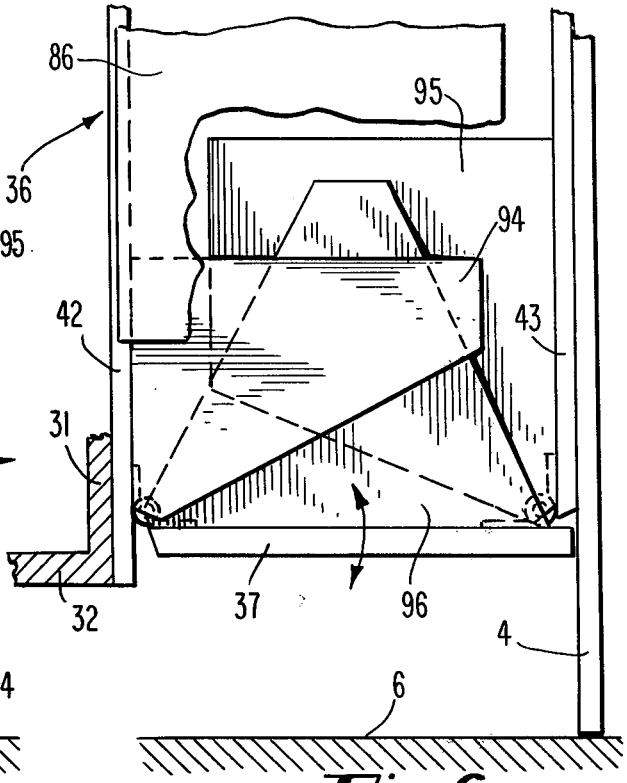
FIG. 6 is a elevational view partially in section looking along the lines 6—6 of FIG. 4 and illustrating the neutral position of the apparatus.
Figure 8:
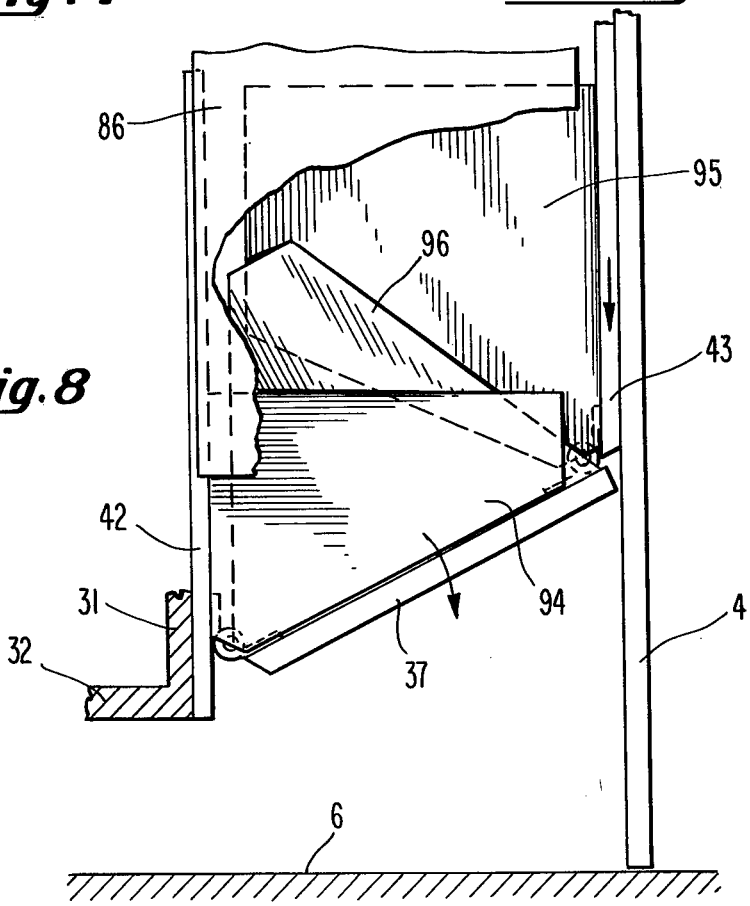
FIG. 8 is a view similar to FIG. 7 and illustrating the fully up position of the apparatus.

The angular position of the plate 37 as shown in FIGS. 6, 7 and 8 or at some intermediate position is set by the vertical position of the adjusting sleeve 63. Normally the plate 37 will be in the down position of FIG. 6, for forming layers 20 and 21. However, the versitility of the apparatus is enhanced by the provision for adjustment in other positions. For example, the neutral position adjustment of FIG. 7 provides the ability for paving without a taper and the up position adjustment of FIG. 8 provides for paving of a curb or an island barrier.

In the neutral position of the bottom plate 37 as shown in FIGS. 3, 4 and 5 it is preferred that the nut 72 be turned down so as to fully compress the spring 73. In this way the apparatus, in effect, becomes an extension of the screed.

In the down position of the bottom plate 37 as shown in FIG. 6, the spring 73 is compressed so that it will develop sufficient pressure ot hold the plate 37 down against the upward thrust of the asphalt (develop compacting pressure) but permit the plate 37 to pivot upwardly in response to irregularities or the contour of surface 6. The above is accomplished as follows:

When the plate is angled to the down position with the outer edge touching the surface 6, then the nut 72 is backed off so that the spring 73 is fully expanded or nearly so. The machine is moved forward to start the paving. The plate 37 will be pivoted upwardly by the thrust of the asphalt.

The nut is then turned down until the spring exerts sufficient force to cause the plate 37 to assume the original down position. Normally, this will not require full compression of the spring. Thus, if the outer edge of the plate 37 momentarily contacts a ridge or a stone, the plate will move up against the force of the spring and then be moved down by the spring when out of contact. The above adjustment is made so that under paving conditions the compacting force of the spring and its ability to yield are compatible.

As noted heretofore, the plate 37 in a fore and aft direction is oriented with respect to the screed compacting plate 32 with a slight bias. This is to enhance the quality of the wedge-shaped layer. The arrangement allows slightly greater unit volume of asphalt to enter under the plate 37 then under the plate 32. Thus, with substantially the same amount of compaction, the layer will have a slightly greater density.

The compacting force of the plate 37 is enhanced by vibration. For this purpose the outboard plate 43 carries U-shaped bracket 74 mounting the conventional vibrator 75. The vibrator is connected to the rotor for the screed vibrator as shown by the shaft means 76.

In connection with the bias of the plate 37 it will be evident (FIG. 4) that the motion of the plate in a lateral vertical plane is at a slight angle to a lateral vertical plane containing the axis of the support 50. This difference is accommodated by the loose fit in the pivot means 64. Further it will be noted (FIG. 5) that the plate 37 moves in a vertical arc while the shaft 70 has linear motion. This difference is accommodated by the previously mentioned rocking ability of the nut 54.

As previously mentioned the outboard plate 43 and the side plates 6 are closely, slidably engaged and both respond to irregularities and/or the contour of the surface being paved and thus have relative vertical motion. The holder 49 maintains the sliding engagement and provides for relative vertical motion.

In connection with the fully down position of the plate 37, it is expedient to provide stop means. This is accomplished by the stops 83 and 84 which respectively are disposed to engage the arms 44 and 45 to establish the fully down position.

The baffle means 36 is designed to present a continuous, closed surface to the asphalt mass irrespective of the angular orientation of the plate 37.

The baffle comprises the lower shutter means 85 and the upper deflector plate 86.

Referring to FIGS. 4 and 9 the deflector plate 86 is mounted on the inboard plate 42 by a strap 90 bolted to plate 42 and having vertical struts 91 and 92 and horizontal struts 93 welded to the deflector plate.

The shutter means 85 is mounted below the deflector plate 86 and is overlapped by same. The shutter has three members shaped to maintain the closed surface in any angled position of the plate 37.

A front member 94 is welded to the inboard plate 42 and extends outwardly normal thereto and is generally in the form of a truncated right triangle. A rear member 95 is welded to the outboard plate 43 and extends outwardly and normal to the plate 43. An intermediate plate 66 is disposed between the plates 94 and 95 and is welded to the bottom plate.

In comparing the positions of the plates 94, 95 and 96 as between FIGS. 6, 7 and 8 it will be evident that the plates 95 and 96 move relative to the fixed plate 94 and in any adjusted position the plates provide a closed surface to the asphalt mass.

Figure 11:
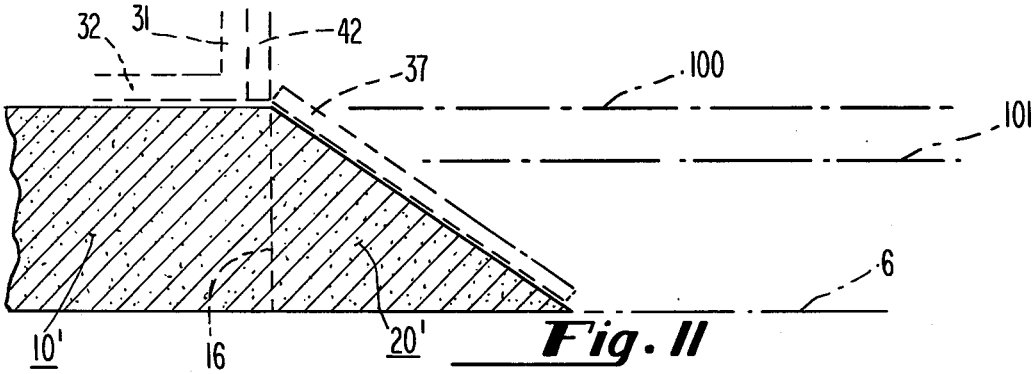
FIGS. 11 and 12 are diagrammatic views illustrating the formation of the joint of the invention.
Figure 12:
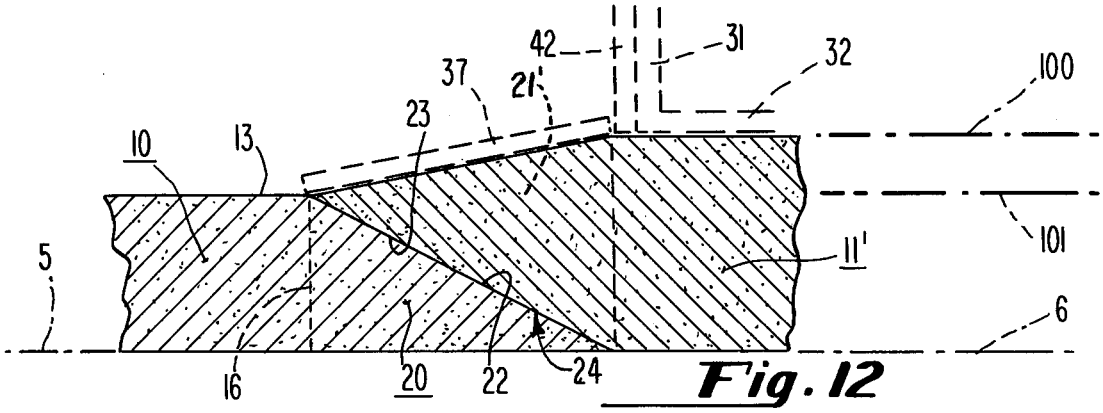

Referring now to FIGS. 11 and 12, I will now briefly describe the formation of a tapered longitudinal joint such as the joint 24 in a typical road re-surfacing operation employing asphalt.

In FIGS. 11 and 12, the screed compacting plate 32 and screed end plate 31 together with the inboard plate 42 and the bottom plate 37 are indicated in dotted lines and for descriptive purposes assume that the dotted lines represent the trailing edges of these members.

In the paving operation in question the bottom, the the screed compacting plate 32 is set at the paving level (line 100) about $1\frac{7}{8}$ inches above the surface 6. The bottom plate 37 is angled down as previously described. Under the foregoing conditions, the screed 6 and apparatus 25 perform the paving function to form sections 10' and 20'.

After the above paving, the asphalt is rolled so as to compact the material down to the compact level (line 101). This forms the section 10 with the working surface 13 and the layer 20. The degree of compacting is about 30% by volume. The rolling process makes a slight distortion in the surface 22 particularly toward the upper end. For descriptive purposes, this has not been shown as it has no substantive affect on subsequent operations.

After paving the first section, the machine is turned around for paving the adjacent section.

The screed compacting plate 100 is set up to the paving level 100 with the outer edge of the plate 37 approximately at the juncture of the surfaces 13 and 22. The higher elevation of the outer edge is accommodated by the spring 73.

As the machine is moved forward, the screed paves the section 11' and the apparatus paves the section 21'. The rolling operation then compacts the section 11' and sayer 21' down to the line 101. This forms the section 11 with work surface 14 and layer 21 as in FIG. 2. The surfaces 13 and 14 are coplanar.

In paving operations where several sections are to be laid down side-by-side, the paver is arranged with an apparatus 25 on each side. The bottom plates of these devices are appropriately angled to attain the desired edges and tapered joints.

It will be understood, that the paving operation as noted above has application for paving new areas including the base course, the binder course and the top surface.

In the foregoing description I have focused on the tapered joint of the invention as between two main paved sections or mats which normally constitute the primary areas for use by traffic, for example, the sections or mats forming a two lane road.

It will be understood that certain of the advantages of the invention are relevant to a tapered joint between a mat and its shoulder and this aspect is commented on below. First, however, it is pointed out that in making a taper on the shoulder edge, the paver is equipped with an apparatus 25 on both of its sides so that while the tapered layer for the longitudinal joint is being formed the tapered layer for the shoulder is also formed.

In FIG. 12 consider the section 10 as constituting one lane of an asphalt roadway without a shoulder. The tapered end surface 22 is adjacent the area which will constitute the shoulder.

The section corresponding to the section 11' in FIG. 12 is filled either manually or by a paver and then rolled to the paving line 101 so as to form the section 11 (FIG. 2) constituting the shoulder. The shoulder and the mat are joined by the tapered joint 24.

As to the fill, the following should be noted. On secondary roads where the shoulder is only 2 or 3 feet wide the fill is done manually. On primary roads such as dual highways the shoulders are on the order of 10 feet in width and the fill is done by a paver with the section 11' being laid down by apparatus 25.

In connection with the tapered joints for shoulders, the invention contemplates a main section or mat formed of concrete and a shoulder formed of asphalt which are interfaced by a tapered joint. A typical joint is shown in FIG. 13.

Figure 13:
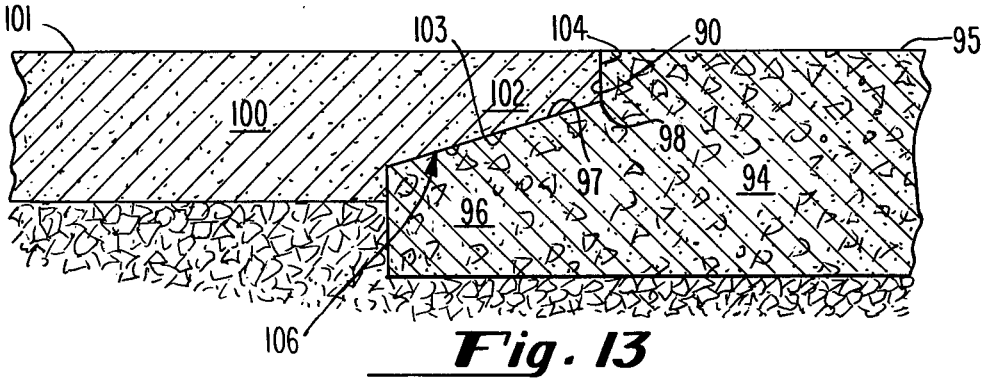
FIG. 13 is a elevational sectional view diagrammatically illustrating a tapered joint between a lane of a concrete roadway and its shoulder.

In FIG. 13, a roadway lane section 94 is formed of concrete and has a work surface 95 and a tapered layer 96 extending outwardly from the edge of the section. The layer has end surface 97 and is downwardly off-set from surface 95 so as to form shoulder 98 including the vertical surface 99. The shoulder 98 forms the juncture between the surfaces 95 and 97.

The shoulder section 100 of the roadway is formed of asphalt and has work surface 101 and tapered layer 102 which extends outwardly and overlies the layer 96. The layer 102 has end surface 103 which engages the end surface 97 and also has vertical surface 104 engaging the vertical surface 98. The asphalt fills the shoulder area 98. As noted, the above sections and layers are disposed on subbase 105.

The layer 102 is downwardly off-set about 1 to 1½ inches so that a relatively shallow but distinct shoulder is formed. This construction is preferred so as to minimize the effects of different coefficients to expansion for concrete and asphalt.

The engaging surface 97/103 and surfaces 98/104 form the joint 106 having a tapered portion and a short vertical portion.

The lane section 94 is paved by a conventional concrete paver equipped with an apparatus 25. In connecting the apparatus 25 to the screed of the paver, the apparatus is disposed so that the bottom plate 37 is below the compacting plate of the screed in a position to form the shoulder 98. The plate 37 is angled so that the taper of the plate 37 is approximately 20°.

The shoulder section 100 is formed with a conventional aspahlt paver equipped with an apparatus 25. The bottom plate 37 is angled so that its outer edge is at the juncture of surfaces 95 and 98. The section 100 and the layer 102 are formed by the asphalt being laid down and roller as previously described.

Before closing I want to comment on the longevity aspect of the above joints.

It is commonly known that a conventional asphalt vertical butt joint opens up and accepts water which, when frozen, further expands the joint which allows in additional water. Furthermore, when the joint is open the edges of the joint are destroyed by traffic.

In the joint of FIG. 2, the highly compacted, tightly engaging the end surfaces 22 and 23 reduce the likelihood of the joint opening and allowing in water to an absolute minimum. Thus, the joint destruction process is similarly minimized. The tight engagement of the end surfaces 22 and 23 is attained by that the layers 20 and 21 receive the direct force of the roller. This direct rolling force and the fact that the end surfaces are relatively hot when rolled creates a good mechanical bond between the surfaces and this effectively mixes the asphalt at the interface so to enhance the bond created when the material cools. The bond rejects the entry of water.

In the joint of FIG. 13, there is a tight engagement between the end surfaces 97 and 103 and between the surfaces 99 and 104 due to the rolling pressure. The resistance to water penetration and separation is enhanced by that the concrete presents a rough surface and the asphalt penetrates the same due to the rolling pressure. This latter feature and the fact that the joint 106 has both vertical and tapered surfaces helps to resist separation.

I claim:

1. In a conventional paving machine including a side plate and a screed with front, end and compacting plates, apparatus disposed in the space between the machine side plate and the end plate of the screed for creating a longitudinal, tapered joint between adjacent sections of paving, the apparatus comprising:

a generally planar bottom plate extending from the screed front plate back along and co-extensive with the screed compacting plate and also extending angularly outwardly from the screed side plate to the machine side plate to form a space, wedge-shaped in cross section, above the surface to be paved whereby paving material flowing under the screed compacting plate will simultaneously flow under the bottom plate to be compacted by the bottom plate into a wedge shape at the same time the screed compacting plate is compacting the material flowing under the same;

connecting means connecting said bottom plate to said screed end plate to be supported thereby; and baffle means extending between and connected with said bottom plate, said screed end plate and said machine side plate generally in the same direction as the screed front plate for directing paving material undereath said bottom plate for said compacting and wedge forming operation.

2. The combination of claim 1 wherein said connecting means includes:

hinge means to provide for change in the angle at which the bottom plate extends outwardly from the screed end plate; and support mechanism having means to position the bottom plate at a desired angle including a compression spring yieldably urging the bottom plate in a downward direction and adjusting mechanism operative when the bottom plate is in the desired angle to compress or relieve the spring to adjust the force thereof on the bottom plate;

said force developing the compacting pressure of the bottom plate;

said adjusting mechanism providing means for determining and maintaining the compacting pressure desired;

said yeilding providing for the bottom plate, when the outer edge thereof is engaged with the surface being paved, to vertically move in response to the contour or irregularities of the surface.

3. The combination of claim 1 wherein said baffle means includes three overlapping members respectively connected to said bottom plate, said screed end plate and said machine side plate to provide a closed surface in any position of adjustment of said bottom plate.

4. The combination of claim 1 wherein said bottom plate, at the leading edge, is spaced above the underside of said screed compacting plate.

5. In a conventional asphalt paving machine including a side plate and a screed with front, end and compacting plates, apparatus disposed in the space between the machine side plate and the end plate of the screed for creating a longitudinal overlapped, wedge joint between adjacent sections of paving the apparatus comprising:

an inboard plate having means for fixedly securing the inboard plate to the end plate of the screed and extending from the screed front plate back along and co-extensive with the screed end plate;

an outboard plate spaced from and extending generally parallel to said inboard plate and generally co-extensive therewith;

means on the outboard plate for connecting the outboard plate to said machine side plate and providing for relative sliding motion in a vertical direction between the outboard plate and the machine side plate;

a generally planar bottom plate connected to said inboard and outboard plates and extending from the screed front plate back along and between the inboard and outboard plates and co-extensive therewith, the bottom plate being oriented angularly outwardly from the inboard plate to form a space, wedge-shaped in cross section, above the surface to be paved whereby asphalt flowing under the screed compacting plate will simultaneously flow under the bottom plate to be compacted by the bottom plate into a wedge shape at the same time the screed compacting plate is compacting the material flowing under the same; and baffle means connected to said bottom plate and to said inboard and outboard plates and extending generally in the same direction as said screed front plate for directing asphalt underneath said bottom plate to be shaped thereby.

6. The combination of claim 5 wherein said baffle means includes three overlapping members respectively connected to said bottom plate and said inboard and outboard plates to provide a closed surface in any position of adjusting of said bottom plate.

7. The combination of claim 6 wherein said baffle means includes a deflector plate and first, second and third members disposed below the deflector plate, the first member being fixed to said inboard plate and extending normally thereto, the second member being fixed to said bottom plate and extending normally thereto and the third member being connected to said outboard plate and extending normally thereto whereby to provide a closed surface in any position of adjusting of said bottom plate.

8. The combination of claim 5 further including:

first and second pivot means respectively connecting the bottom plate to said inboard and outboard plates to provide for change in the angle at which the bottom plate extends outwardly from the inboard plate; and support mechanism connected between said inboard plate and said bottom plate, the connection to the bottom plate being spaced outwardly from the first pivot means and the support mechanism having means to position the bottom plate at a desired angle including a compression spring yieldably urging the bottom plate in a downward direction and adjusting mechanism operative when the bottom plate is in the desired angle to compress or relieve the spring to adjust the force thereof on the bottom plate;

said force developing the compacting pressure of the bottom plate;

said adjusting mechanism providing means for determining and maintaining the compacting pressure desired;

said yielding providing for the bottom plate, when the outer edge thereof is engaged with the surface being paved, to vertically move in response to the contour or irregularities of the surface.

9. The combination of claim 5 further including:

hinge means on opposite edges of the bottom plate and respectively connecting the bottom plate to said inboard and outboard plates;

a pair of links respectively extending between the inboard and outboard plates, the opposite ends of each link having a pivotal connection with the inboard and outboard plates and the pivotal connection maintaining the links generally parallel with the bottom plate;

a pair of spaced apart, yieldable supports respectively connecting the bottom plate to said inboard plate, each support comprising:

(a) support means connected to said inboard plate and extending outwardly therefrom, the support means having a threaded vertical aperture;

(b) a threaded adjusting sleeve in said threaded aperture, the sleeve having a vertical extending bore and having means engagable by a tool for turning the sleeve in the bore to adjust the vertical location thereof;

(c) pivot means mounted on said bottom plate;

(d) a shaft slidably mounted in said bore and connected to the pivot means, the shaft having threads on the top portion thereof;

(e) nut means on said shaft in movable engagement with the top of said sleeve;

(f) compression spring means surounding said shaft, the top of the spring means engaging said sleeve and the bottom of the spring means engaging said pivot means and urging said shaft downwardly in said bore to a position wherein said nut engages the top of said sleeve;

(g) the engagement of said nut means with the top of said sleeve supporting said shaft, said spring, said pivot means, said bottom plate, and said outboard plate from the support means;

(h) said spring means permitting said shaft and nut means, said pivot means, said bottom plate, and said outboard plate to move upwardly relative to said support means;

(i) the vertical position of said sleeve in said support means and the vertical position of said shaft in said bore determining said orientation of said bottom plate;

10. The combination of claim 9 further including stop means connected to and extending outwardly from said inboard plate.

11. The combination of claim 9 further including bracket means on said outboard plate and adapted to support a vibrator mechanism.

12. The method of forming a longitudinal, tapered joint between first and second sections of highly compacted asphalt paving material which cover an area, comprising the steps of:

during the paving of the first section form a highly compacted first tapered layer which extends outwardly from an edge of the section; and during the paving of the second section form a second highly compacted tapered layer which extends outwardly from an edge of the second section which is adjacent first said edge and which overlies and engages the first layer to form a tapered joint between the sections, said forming of the second layer being carried out to cause the asphalt at the joint to mix and create a bond to resist the liklihood of the joint opening and allowing entry of water.

13. A tapered joint formed according to the method of claim 12.

14. The method of forming a longitudinal, tapered joint between first and second adjacent sections of highly compacted asphalt paving material which cover an area, comprising the step of:

during the paving of said first section form along one edge of the first section a highly compacted first layer of asphalt which extends outwardly from the edge and is tapered downwardly from the top surface of the section; and during the paving of said second section form along an edge the second section which is adjacent first said edge a highly compacted second layer of asphalt which extends outwardly from the edge of the second section and is tapered upwardly from the bottom surface of the second section and which overlies and engages said first layer to form a tapered joint between said sections, said forming of the second layer being carried out to cause the asphalt at the joint to mix and create a bond to resist the liklihood of the joint opening and allowing entry of water.

15. A tapered joint formed according to the method of claim 14.

16. The combination of claim 6 further including vibrator mechanism mounted on said outboard plate.

* * * * *